United States Patent [19]

Kottwitz et al.

[11] Patent Number: 4,790,932

[45] Date of Patent: Dec. 13, 1988

[54] N-ALKYL AND N-ALKENYL ASPARTIC ACIDS AS CO-COLLECTORS FOR THE FLOTATION OF NON-SULFIDIC ORES

[75] Inventors: Beatrix Kottwitz; Wolfgang von Rybinski; Rita Koester, all of Duesseldorf, Fed. Rep. of Germany

[73] Assignee: Henkel Kommanditgesellschaft auf Aktien, Duesseldorf, Fed. Rep. of Germany

[21] Appl. No.: 128,303

[22] Filed: Dec. 3, 1987

[30] Foreign Application Priority Data

Dec. 5, 1986 [DE] Fed. Rep. of Germany ..... 3641579

[51] Int. Cl.[4] ..... B03D 1/02

[52] U.S. Cl. ..... 209/166; 252/61

[58] Field of Search ..... 209/166, 167; 252/61; 562/571

[56] References Cited

U.S. PATENT DOCUMENTS

| | | | |
|---|---|---|---|
| 2,200,220 | 5/1940 | Reppe | 562/571 |
| 2,438,091 | 3/1948 | Lynch | 260/170 |
| 3,830,366 | 9/1974 | Day et al. | 209/166 |
| 3,890,242 | 6/1975 | Carry | 252/107 |
| 3,937,807 | 2/1976 | Haefele | 424/54 |
| 3,988,433 | 11/1976 | Benedict | 252/99 |
| 4,000,080 | 12/1976 | Bartolotia | 252/99 |
| 4,043,902 | 8/1977 | Hartjens et al. | 209/166 |
| 4,199,064 | 4/1980 | Holme | 209/166 |
| 4,213,961 | 7/1980 | Curtis | 424/54 |
| 4,229,287 | 10/1980 | Lepetic | 209/166 |
| 4,472,297 | 9/1984 | Bolich, Jr. | 252/DIG. 13 |

FOREIGN PATENT DOCUMENTS

| | | |
|---|---|---|
| 2443460 | 3/1976 | Fed. Rep. of Germany . |
| 0076974 | 9/1970 | German Democratic Rep. . |

OTHER PUBLICATIONS

E. Topfer, Xth International Mineral Proc. Congress, p. 626, 627, London, 1973.

H. Schubert et al., XIIth International Mineral Proc. Congress, 1977, pp. 243–279.

*Primary Examiner*—Kenneth M. Schor

*Assistant Examiner*—Thomas M. Lithgow

*Attorney, Agent, or Firm*—Ernest G. Szoke; Henry E. Millson, Jr.; Real J. Grandmaison

[57] ABSTRACT

Use of N-alkyl and/or N-alkenyl aspartic acids or salts thereof as co-collectors in the flotation of non-sulfidic ores and a process for the separation of non-sulfidic ores by flotation wherein N-alkyl and/or N-alkenyl aspartic acids or salts thereof are used in collector mixtures.

18 Claims, No Drawings

N-ALKYL AND N-ALKENYL ASPARTIC ACIDS AS CO-COLLECTORS FOR THE FLOTATION OF NON-SULFIDIC ORES

BACKGROUND OF THE INVENTION

1. Field of the Invention

This invention relates to the use of N-alkyl and/or N-alkenyl aspartic acids as co-collectors in the flotation of non-sulfidic ores, and to a process for the separation of non-sulfidic ores by flotation.

2. Statement of Related Art

Flotation is a separation technique commonly used in the dressing of mineral raw materials for separating valuable minerals from the gangue. Non-sulfidic minerals, such as for example apatite, fluorite, scheelite and other salt-like minerals, cassiterite and other metal oxides, such as titanium or zirconium oxides, and also certain silicates and aluminosilicates can be dressed by flotation processes. For flotation, the ore is subjected to preliminary size-reduction, dry-ground, or preferably wet-ground, and suspended in water. Collectors are normally added to these suspensions, frequently in conjunction with auxiliary reagents, such as frothers, regulators, depressors (deactivators) and/or activators in order to facilitate separation of the valuable minerals from the gangue constituents of the ore in the subsequent flotation process. These reagents are normally allowed to act on the finely ground ore for a certain time (conditioning) before air is blown into the suspension (flotation). A froth is thus produced on the surface of the suspension, the collector having a hydrophobicizing effect on the surface of the minerals. The minerals adhere to the gas bubbles formed during the aeration step, the mineral constituents being selectively hydrophobicized so that the unwanted constituents of the ore do not adhere to the gas bubbles. The mineral-containing froth is stripped off and further processed in known manner. The object of flotation is to recover the valuable mineral of the ores in as high a yield as possible while at the same time obtaining a high enrichment level.

Anionic and cationic surfactants are predominantly used as collectors in the flotation of non-sulfidic ores. These collectors are intended to be selectively adsorbed to the surface of the valuable minerals in order to obtain a high enrichment level in the flotation concentrate. In addition, the collectors are intended to form a buoyant, but not too stable flotation froth. For ores containing gangue minerals which are not hydrophobicized by anionic collectors, such as for example unsaturated and saturated fatty acids, particularly tall oil fatty acids and oleic acids, alkyl sulfates or sulfonates, it is sufficient to use anionic surfactants such as these as collectors. Ores that are more difficult to float, such as tin ores for example, require more selective collectors, such as for example phosphonic acids (German Pat. No. 2,443,460 and East German Pat. No. 76,974), or alkyl sulfosuccinamides (U.S. Pat. No. 3,830,366).

Suitable organic phosphonates for the flotation of non-sulfidic ores, particularly tin ores, include water-soluble salts or organic phosphonic acids, for example salts of styrene phosphonic acid, as described for example in the Xth International Mineral Proc. Congress—IMM, E. Topfer, pages 626 to 627, London, 1973 (O. S. Bogandow).

Collectors frequently used in the flotation of non-sulfidic ores are, for example, alkyl monocarboxylic acids, such as for example unsaturated long-chain fatty acids, such as the tall oil fatty acid disclosed above. However, di- and tricarboxylic acids are also used as collectors for flotation (H. Schubert, H. Baldauf, A. Serrano, XIIth International Mineral Proc. Congress, Sao Paulo, 1977).

By virtue of their surfactant character, many collectors for non-sulfidic ores themselves develop a froth suitable for flotation. However, it may also be necessary to develop or suitably to modify the froth by special frothers. Known flotation frothers include $C_4$–$C_{10}$ alcohols, propylene glycols, polyethylene glycol or polypropylene glycol ethers, terpene alcohols (pine oils), and cresylic acids. If necessary, modifying reagents, for example pH regulators, activators for the mineral to be recovered in the froth or deactivators for unwanted minerals in the froth and possibly even dispersants are added to the flotation suspensions (pulps).

In many cases, the anionic and nonionic collectors used for the flotation of non-sulfidic ores do not lead to satisfactory recovery of the valuable minerals when used in economically reasonable quantities.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to find improved collectors which make flotation processes more economical, i.e. with which it is possible to obtain either greater yields of valuable minerals for the same quantities of collector and for the same selectivity or the same yields of valuable materials for reduced quantities of collector.

It has surprisingly been found that N-alkyl and/or N-alkenyl aspartic acids can be used with advantage as co-collectors in the flotation of non-sulfidic ores.

The N-alkyl and/or N-alkenyl radicals of the aspartic acids used in accordance with the invention are linear or branched and contain from 2 to 22 carbon atoms and, optionally, a hydroxyl group and/or—instead of a $CH_2$ group—an ether bridge.

In addition to the free acids of the N-alkyl and N-alkenyl aspartic acids, alkali metal or ammonium salts thereof can also be used. The corresponding potassium salts and, preferably, the corresponding sodium salts of the N-alkyl and/or N-alkenyl aspartic acids are advantageously used herein.

Whereas the alkyl and/or alkenyl radicals of the N-alkyl and/or N-alkenyl aspartic acids are normally linear or branched and contain from 2 to 22 carbon atoms and, optionally, a hydroxyl group and/or—instead of a $CH_2$ group—an ether bridge, N-alkyl and/or N-alkenyl aspartic acids of which the alkyl and/or alkenyl radicals contain from 8 to 18 carbon atoms are preferably used.

The production of N-alkyl and/or N-alkenyl amino acids and alkali metal or ammonium salts thereof is generally known from the literature. It can be carried out by any of the various alkylation reaction at the nitrogen atom of the amino acid, as described for example in Houben-Weyl, Vol. 11/2, or by the addition of primary or secondary amines to unsaturated carboxylic acids (J. March "Advanced Organic Chemistry: Reactions, Mechanism and Structure", McGraw-Hill, 1977).

The N-alkyl and/or N-alkenyl aspartic acids and salts of the invention are prepared by the second method starting from maleic acid esters. The maleic acid esters can be reacted with the corresponding amine component either in a solvent (U.S. Pat. No. 2,438,092) or in the absence of a solvent, optionally in the presence of a catalyst, such as for example acetic acid, alkali metal thiocyanates or O,N-dialkyl phosphocarbamates (USSR Pat. No. 771,087).

According to the invention, anionic and/or nonionic collectors can be used in addition to N-alkyl and/or N-alkenyl aspartic acids in a molar ratio of from 20:1 to 1:20.

In one preferred embodiment of the invention, tallow alkyl sulfosuccinamides and/or oleic acid are used in addition to N-alkyl and/or N-alkenyl aspartic acids as anionic collectors.

A reaction product of propylene glycol glucoside with α-dodecane epoxide for example can be used with advantage as a nonionic collector.

The quantities in which the co-collectors of the invention are used depend upon the particular type of non-sulfidic ores to be floated and upon their valuable mineral content. Accordingly, the particular quantities required may vary within wide limits. In general, the co-collectors according to the invention are used in collector mixtures in quantities of from 50 to 2000 g/t crude ore.

In practice, the N-alkyl and/or N-alkenyl aspartic acids in combination with anionic, cationic and/or nonionic collectors are used instead of known collectors in known flotation processes for non-sulfidic ores. Accordingly, the particular reagents commonly used, such as frothers, regulators, activators, deactivators, etc., are again added to the aqueous suspensions of the ground ores in addition to the collector mixtures. Flotation is carried out under the same conditions as state-of-the-art processes. In this connection, reference is made to the following literature references on ore preparation technology: A. Schubert, Aufbereitung fester mineralischer Rohstoffe, Leipzig, 1967; B. Wills, Mineral Processing Technology, New York, 1978; D. B. Purchas (ed.), Solid/Liquid Separation Equipment Scale-up, Croydon, 1977; E. S. Perry, C. J. van Oss, E. Grushka (ed.), Separation and Purification Methods, New York, 1973–1978.

The N-alkyl and/or N-alkenyl aspartic acids according to the invention can be used, for example, as co-collectors in the flotation-based dressing of scheelite ore, cassiterite ore and fluorite ore.

The present invention also relates to a process for the separation of non-sulfidic ores by flotation, in which crushed ore is mixed with water to form an ore suspension, air is introduced into the suspension in the presence of the collector mixture and the froth formed is stripped off together with the mineral therein. This process if characterized in that N-alkyl and/or N-alkenyl aspartic acids are used as co-collectors.

The following Examples, which are given for illustration purposes only, demonstrate the superiority of the co-collectors used in accordance with the invention. The tests were carried out under laboratory conditions, in some cases with increased collector concentrations considerably higher than necessary in practice. Accordingly, the potential applications and in-use conditions are not limited to the separation exercises and test conditions described in the Examples. All percentages are percentages by weight, unless otherwise indicated. The quantities indicated for reagents are all based on active substance.

EXAMPLES

Production Example 172 g of maleic acid diethyl ester were added dropwise at 60° C. to 259 g of technical tallow amine (16 to 18 carbon atoms) and 6 g of glacial acetic acid; the internal temperature did not exceed 70° C. The reaction solution was left standing for 5 h at 70° C. and then heated to 90° C. 80 g of NaOH dissolved in 970 ml of water were then added and the temperature kept at 85° to 90° C. for 1 hour.

FLOTATION TESTS

Examples 1 and 2 and Comparison Example 1

The material to be floated was a scheelite ore from Austria which had the following chemical composition, based on its principal constituents:

$WO_3$: 0.3%
CaO: 8.8%
$SiO_2$: 55.8%

The ore sample had the following particle size distribution:

28%: less than 25 μm
43%: 25–100 μm
29%: 100–200 μm

Combinations of a sulfosuccinamide derived from a tallow amine with sodium salts of N-alkyl aspartic acids in a ratio by weight of 2:1 were used as collector mixtures according to the invention. The chain length of the N-alkyl aspartic acids was $C_{16}$–$C_{18}$ in Example 1 and $C_{12}$–$C_{14}$ in Example 2. The tallow alkyl sulfosuccinamide mentioned above was used as comparison collector (Comparison Example 1).

The flotation tests were carried out in a 1 liter flotation cell using a Humbold-Wedag laboratory flotation machine of the type manufactured by KHD Industrieanlagen AG, Humbold-Wedag, Cologne (see Seifen-Fette-Wachse 105 (1979), page 248). Deionized water was used to prepare the pulp. The pulp density was 400 g/l. Waterglass was used as depressor in a quantity of 2000 g/t. The conditioning time of the depressor was 10 minutes at a stirring speed of 2000 l/minute.

Flotation was carried out carried out at the pH value of approx. 9.5 obtained by addition of the waterglass. The collector dosage is shown in Table 1 below. The conditioning time of the collector was 3 minutes.

The results of Table 1 show that a distinctly higher enrichment level and a better recovery are obtained with the collector combinations according to the invention than with the alkyl sulfosuccinamide of Comparison Example 1 along.

Table 1

Flotation of an Austrian scheelite ore, KHD cell; pulp density 400 g/l, natural pH, 2000 g/t waterglass

| Example | Dosage (g/t) | $R_{total}$ (%) | $R_{WO_3}$ (%) | Concentrate $WO_3$ | Concentrate CaO | Concentrate $SiO_2$ |
|---|---|---|---|---|---|---|
| Comparison | 500 | 0.6 | 19 | 10.6 | 8.6 | 34.8 |
| Example 1 | 500 | 0.8 | 64 | 28.3 | 15.8 | 21.1 |
| | 400 | 0.6 | 11 | 5.6 | 22.8 | 25.8 |
| | Σ900 | 1.4 | 75 | 18.4 | 19.0 | 23.3 |
| Example 2 | 500 | 1.0 | 38 | 13.3 | 19.4 | 22.8 |
| | 500 | 1.2 | 20 | 5.6 | 27.6 | 20.6 |
| | Σ1000 | 2.2 | 58 | 9.1 | 24.2 | 21.4 |

Example 3 and Comparison Example 2

The material to be floated was a South African cassiterite ore low in valuable minerals and essentially containing granite, tourmaline and magnetite as gangue. The flotation batch had the following particle size distribution:

49.5%: less than 25 μm
43.8%: 25–63 μm
6.7%: more than 63 μm

The flotation tests were carried out in a 1 liter laboratory flotation cell at room temperature. Waterglass (dosage 2000 g/t) was used as depressor and the value of the pulp was adjusted to pH 5 with sulfuric acid before addition of the collector. Flotation was carried out at a pulp density of 500 g of ore per liter of tapwater having a hardness of 16° Gh. The flotation time in the rougher flotation step was 4 minutes at a stirring speed of 1200 l/minute.

The sodium salt of N-tallow alkyl aspartic acid having a chain length of 16 to 18 carbon atoms was used as the co-collector according to the invention. A propylene glycol glucoside reacted with α-dodecane epoxide was used as collector. The mixing ratio of collector to co-collector was 1:2 (Example 3). Technical styrene phosphonic acid was used for Comparison Example 2.

A higher $SnO_2$ content in the concentrate can be obtained with the co-collector according to the invention in combination with the alkyl glucoside than with the styrene phosphonic acid, the metal recovery level remaining the same despite the lower collector dosage.

TABLE 2

| Flotation of a South African cassiterite ore; 1 liter Denver cell | | | | | | | |
|---|---|---|---|---|---|---|---|
| | Dosage | Flotation | $R_{total}$ | $R_{SnO_2}$ | Concentrate | | |
| Example | (g/t) | stage | (%) | (%) | $SnO_2$ | $SiO_2$ | $Fe_2O_3$ |
| Comparison Example 2 | 450 | | | 82 | 5.8 | 40.2 | 13.5 |
| Example 3 | 150 | rt | 72.3 | — | <0.1 | 72.6 | 4.8 |
| | 50 | rc1 | 14.2 | 84 | 9.6 | 24.5 | 27.2 |
| | 50 | rc2 | 7.4 | 13 | 2.9 | 40.1 | 22.3 |
| | | rc3 | 6.1 | 3 | 0.7 | 48.2 | 18.5 |
| | | batch | 100.0 | 100 | 1.62 | 61.9 | 10.1 |

rt = Rougher flotation tailings
rc = Rougher flotation concentrate

Example 4 and Comparison Example 3

The material to be floated was a Mexican fluorite ore predominantly containing silicates as gangue. The flotation batch has the following particle size distribution:

35%: less than 25 μm
50%: 25–80 μm
15%: more than 80 μm

The rougher filtration concentrate was further ground before the following purification stages. Thereafter, the particle size was:

98%: −44 μm

The flotation tests were carried out in a 1 liter Denver cell using extremely hard water (350° Gh). The depressor was alkali-hydrolyzed starch in a quantity of 1000 g/t.

The Na salt of N-tallow alkyl aspartic acid having a chain length of 16 to 18 carbon atoms in combination with oleic acid in a ratio of 1:9 was used as the co-collector according to the invention (Example 4). The standard collector was oleic acid (Comparison Example 3).

The results in Table 3 show that the combination of the co-collector according to the invention with oleic acid gives a better recovery of fluorite and a higher concentrate content for a lower dosage.

TABLE 3

| | Dosage | Flotation | $R_{total}$ | $R_{CaF_2}$ | Concentrate | | |
|---|---|---|---|---|---|---|---|
| Example | (g/t) | stage | (%) | (%) | $CaF_2$ | CaO | $SiO_2$ |
| Comparison Example 3 | 1000 | rt | 66.2 | 14 | 4.3 | 5.6 | 75.9 |
| | | ct | 14.9 | 14 | 19.1 | 15.2 | 61.5 |
| | | conc. | 18.9 | 72 | 77.9 | 57.7 | 11.2 |
| | | batch | 100.0 | 100 | 20.4 | 16.9 | 61.5 |
| Example 4 | 670 | rt | 61.7 | 14 | 4.9 | 4.4 | 73.1 |
| | | ct | 17.0 | 4 | 5.3 | 9.4 | 70.7 |
| | | conc. | 21.3 | 82 | 82.2 | 61.3 | 8.7 |
| | | batch | 100.0 | 100 | 21.4 | 17.4 | 59.0 |

rt = Rougher flotation tailings
ct = purifying flotation tailings
conc. = Concentrate

We claim:

1. In a process for the froth flotation of non-sulfidic mineral-containing ores, the improvement comprising the use, as a flotation agent, of an anionic and/or non-ionic collector surfactant in conjunction with at least one N-alkyl and/or N-alkenyl aspartic acid or salt thereof as a co-collector, in an amount sufficient to selectively concentrate the non-sulfidic mineral in the froth.

2. The process of claim 1 wherein in the N-alkyl and/or N-alkenyl aspartic acid, the alkyl or alkenyl radicals are linear or branched and contain from 2 to 22 carbon atoms and are selected from the group consisting of unsubstituted radicals, hydroxyl substituted radicals, radicals containing an ether bridge in place of a —$CH_2$-group, and a hydroxyl substituted radical which contains an ether bridge in place of a —$CH_2$-group.

3. The process of claim 2 wherein in the N-alkyl and/or N-alkenyl aspartic acid, the alkyl or alkenyl radicals contain from 8 to 18 carbon atoms.

4. The process of claim 1 wherein the potassium salt, the ammonium salt, or the sodium salt of the N-alkyl and/or N-alkenyl aspartic acid is employed.

5. The process of claim 1 wherein the molar ratio of the anionic and/or nonionic collectors to the N-alkyl and/or N-alkenyl aspartic acids or salts thereof is from about 20:1 to about 1:20.

6. The process of claim 5 wherein tallow alkyl sulfosuccinamide and/or oleic acid are used as anionic collectors.

7. The process of claim 5 wherein a reaction product of propylene glycol glucoside with α-dodecane epoxide is used as a nonionic collector.

8. The process of claim 1 wherein the co-collector is present in a collector mixture in a quantity of from about 50 to about 2000 g/t of ore.

9. The process of claim 1 in which the ore is a scheelite, cassiterite, of fluorite ore.

10. A process for the separation of a mineral-containing non-sulfidic ore by froth flotation comprising the steps of:

(a) mixing the non-sulfidic ore in ground form with water to form a suspension;

(b) forming a froth by introducing air into the suspension in the presence of a collector mixture containing an anionic and/or nonionic collector surfactant in conjunction with at least one N-alkyl and/or N-alkenyl aspartic acid or salt thereof as co-collector, in an amount sufficient to selectively concentrate the non-sulfidic mineral in the froth; and (c) removing the mineral-containing froth.

11. The process of claim 10 wherein the co-collector in the collector mixture is present in a quantity of from about 50 to about 2000 g/t of ore.

12. The process of claim 11 in which the ore is a scheelite, cassiterite, or fluorite ore.

13. The process of claim 10 wherein in step (b) in the N-alkyl and/or N-alkenyl aspartic acid, the alkyl or alkenyl radicals are linear or branched and contain from 2 to 22 carbon atoms and are selected from the group consisting of unsubstituted radicals, hydroxyl substituted radicals, radicals containing an ether bridge in place of a —$CH_2$-group, and a hydroxyl substituted radical which contains an ether bridge in place of a —$CH_2$-group.

14. The process of claim 13 wherein in the N-alkyl and/or N-alkenyl aspartic acid, the alkyl or alkenyl radicals contain from 8 to 18 carbon atoms.

15. The process of claim 10 wherein in step (b) the potassium salt, the ammonium salt, or the sodium salt of the N-alkyl and/or N-alkenyl aspartic acid is employed.

16. The process of claim 10 wherein in step (b) tallow alkyl sulfosuccinamide and/or oleic acid are used as anionic collectors.

17. The process of claim 10 wherein in step (b) a reaction product of propylene glycol glucoside with α-dodecane epoxide is used as a nonionic collector.

18. The process of claim 10 wherein the molar ratio of the anionic and/or nonionic collectors to the N-alkyl and/or N-alkenyl aspartic acids or salts thereof is from about 20:1 to about 1:20.

* * * * * .